US006416206B1

(12) United States Patent
Leen

(10) Patent No.: US 6,416,206 B1
(45) Date of Patent: Jul. 9, 2002

(54) SINGLE CAP SPARE HALOGEN BULB STORAGE CONTAINER

(76) Inventor: Monte A. Leen, 11730 NE. 12th St., Bellevue, WA (US) 98005

( * ) Notice: Subject to any disclaimer, the term of this patent is extended or adjusted under 35 U.S.C. 154(b) by 0 days.

(21) Appl. No.: 09/761,334

(22) Filed: Jan. 16, 2001

(51) Int. Cl.[7] ..... F21S 6/00

(52) U.S. Cl. ..... 362/410; 362/374; 362/263; 362/375

(58) Field of Search ..... 206/418, 419; 362/374, 375, 457, 458, 207, 253, 263, 184, 410

(56) References Cited

U.S. PATENT DOCUMENTS 5,695,278 A 12/1997 Grossman et al. ..... 362/374
5,845,989 A 12/1998 Leen ..... 362/410

*Primary Examiner*—Sandra O'Shea
*Assistant Examiner*—Hargobind S. Sawhney
(74) *Attorney, Agent, or Firm*—Dean A. Craine

(57) ABSTRACT

A halogen work light with a spare bulb container integrally attached thereto is disclosed. The spare bulb container includes a tubular body and a support piece that fits inside the closed end of the tubular body and an end piece that friction fits into the open end of the tubular body. The support piece and end piece both include a longitudinal hole for receiving the ends of a spare halogen bulb and holding the bulb in a suspended position inside the tubular body. Both the support pieces are formed of a soft, resilient material, such as rubber.

2 Claims, 3 Drawing Sheets

SINGLE CAP SPARE HALOGEN BULB STORAGE CONTAINER

BACKGROUND OF THE INVENTION

1. Field of the Invention

This invention relates to spare bulb holders, and, more particularly to spare bulb holders attached to work lights.

2. Description of the Related Art

In recent years, a variety of types of high- and low-profile halogen work lights have been developed. In the past, one of the major disadvantages of halogen work lights has been the lack of a readily accessible spare halogen bulb for installation when a bulb in the work light burns out on the job site. While spare bulbs may be stored in work boxes, work vehicles, and the like, it is an inconvenience to retrieve the spare bulb from these locations. Further, they are subject to damage when stored in this manner.

To remedy this, a spare bulb container has been invented (U.S. Pat. No. 5,845,989) that is integrally attached to the frame of the work light. Two removable end pieces hold the bulb in a central position within a hollow tube and prevent it from sliding out. Unfortunately, one or both end caps may become dislodged and lost during use, thereby preventing the tube from being used.

What is needed is an integrally attached spare halogen bulb storage container with a single removable cap.

SUMMARY OF THE INVENTION

It is an object of the present invention to provide a spare halogen bulb container.

It is a further object of the invention to provide such a container that uses only one end cap.

In accordance with this invention, an integrally attached spare bulb container for a halogen work light is provided comprising an elongate, tubular body integrally attached to the work light. The tubular body is opened at one end with a support piece placed inside the tubular body adjacent to the closed end of the body with a tip receiving aperture formed therein to receive the end of a halogen bulb. In the preferred embodiment, the support piece is made of elastic material that can be wedged and held in position inside the tubular body. Attached over the opposite open end of the tubular body is a removable cap piece with a tip receiving aperture sized to receive the opposite end of a halogen bulb.

In the preferred embodiment, the cap end is formed of elastic material and held in the end of the tubular body by friction.

The tubular body may be welded to the frame or legs of the work light.

DESCRIPTION OF THE PREFERRED EMBODIMENT(S)

Figure 1:
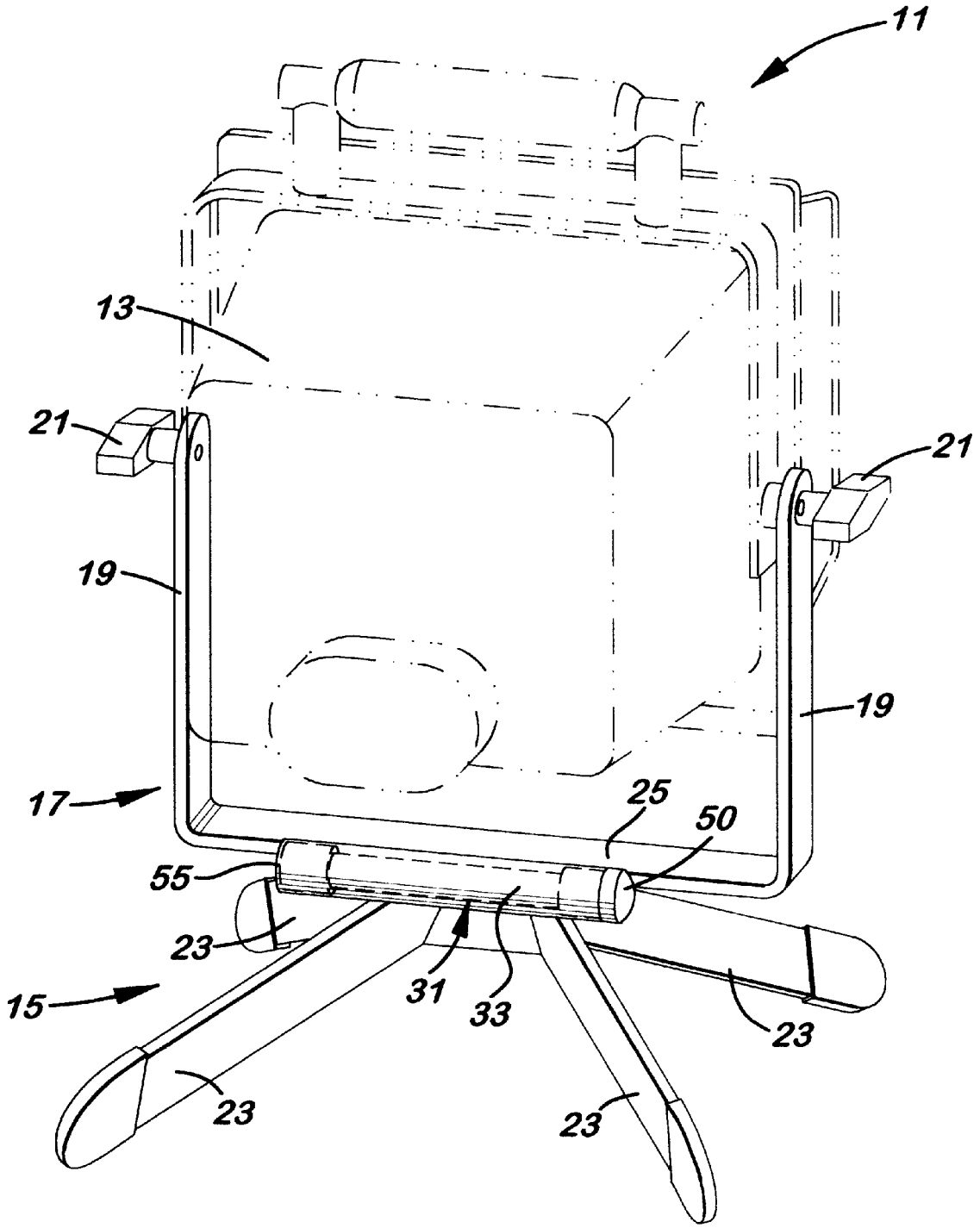
FIG. 1 is an isometric view of an embodiment of the invention incorporated in one type of halogen work light.

FIG. 1 illustrates a halogen work light 11 incorporating the invention. The halogen work light 11 includes a halogen lamp 13, shown in phantom, that includes an open-sided housing formed of metal, such as aluminum. As well known to those familiar with halogen work lights, the halogen lamp 13 also includes a reflector mounted in the housing and an elongate halogen bulb. The opening in the housing is enclosed by a glass lens that is held in place by a frame. The frame supports a protective grill formed either of a plurality of thin wires welded together, or cast as a single unit with the frame. The grill provides a protective shield in front of the glass lens. For a more detailed description of a halogen lamp of the type shown in FIG. 1, attention is directed to U.S. Pat. No. 5,845,989 filed Oct. 10, 1996, the subject matter of which is incorporated herein by reference.

The halogen work light 11 shown in FIG. 1 also includes a support frame 15. The support frame 15 includes a U-shaped section 17. The halogen lamp 13 is mounted between the legs 19 of the U-shaped section 17. More specifically, an attachment mechanism in the form of lock bolts 21 having T-shaped outer ends pass through holes in the upper end of the legs 19. The lock bolts 21 are threaded into holes in the sides of the housing of the halogen lamp 13. Attention is directed to U.S. patent application Ser. No. 09/729,660, referenced more fully above, and incorporated herein by reference, for a more detailed description of this attachment mechanism.

The support frame 15 also includes four legs 23 that are affixed to and extend downwardly and outwardly from the center region of the bottom of the cross-member 25 of the U-shaped section 17. Preferably, the U-shaped section 17 and the legs 23 are formed of iron, and the legs 23 are welded to the cross-member 25.

As will be better understood from the following description, the present invention is not specifically directed to halogen work lights of the type shown in FIG. 1. That is, the work light shown in FIG. 1 should be taken as exemplary, not limiting. Further, in addition to finding use with a wide variety of low-profile work lights, including the type shown in FIG. 1, the invention can also be used with high-profile work lights, i.e., work lights mounted on tripods and other elevation-raising mechanisms.

The present invention is directed to a spare bulb container 31 that is integral with a halogen work light. In the exemplary halogen work light shown in FIG. 1, the spare bulb container 31 is affixed to the cross-member 25 of the U-shaped section 17 of the frame 15.

Figure 2:
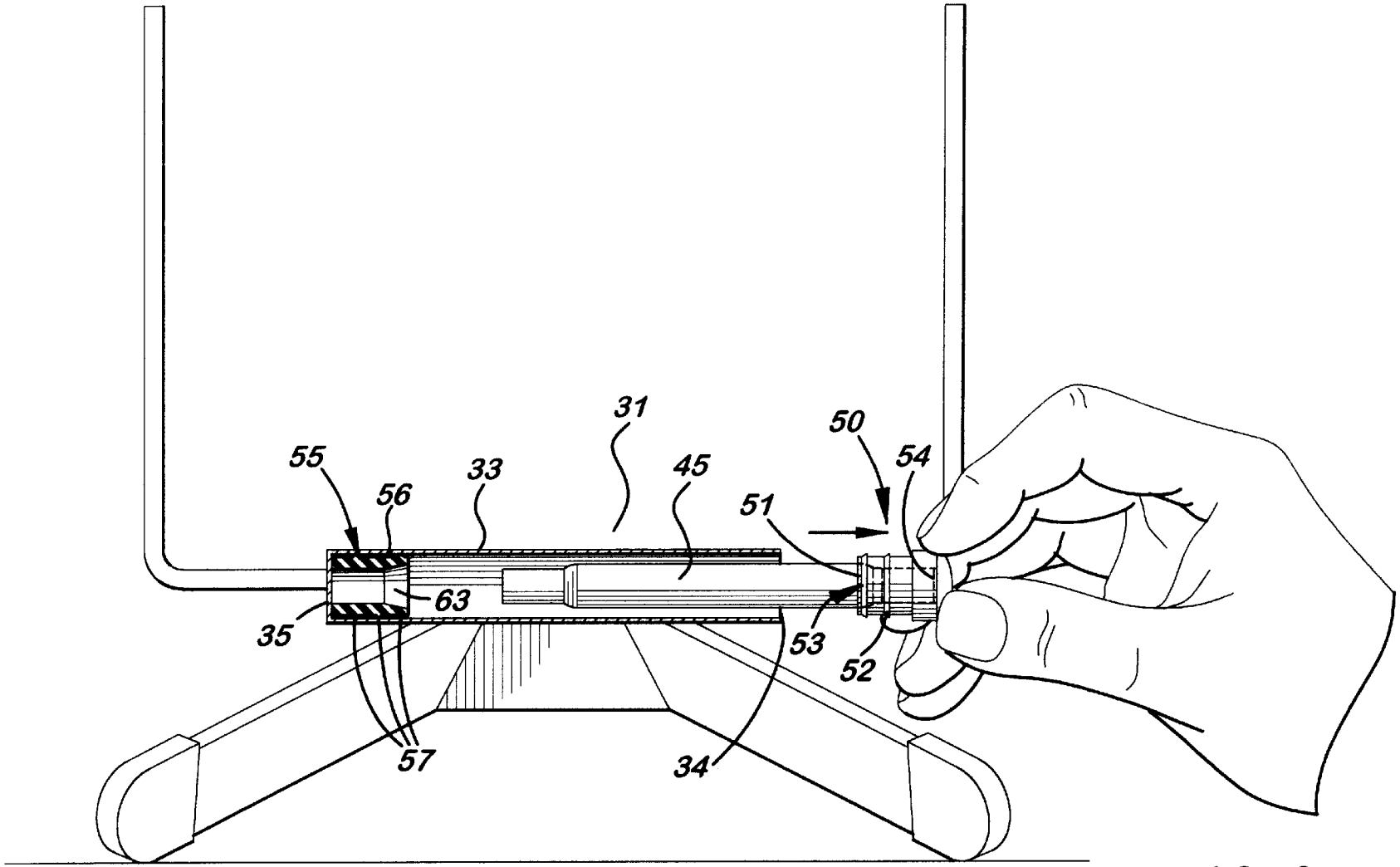
FIG. 2 is a cross-sectional side elevation view of the embodiment of the invention showing the placement of the support piece inside the tubular body and the spare halogen bulb being removed therefrom.
Figure 3:
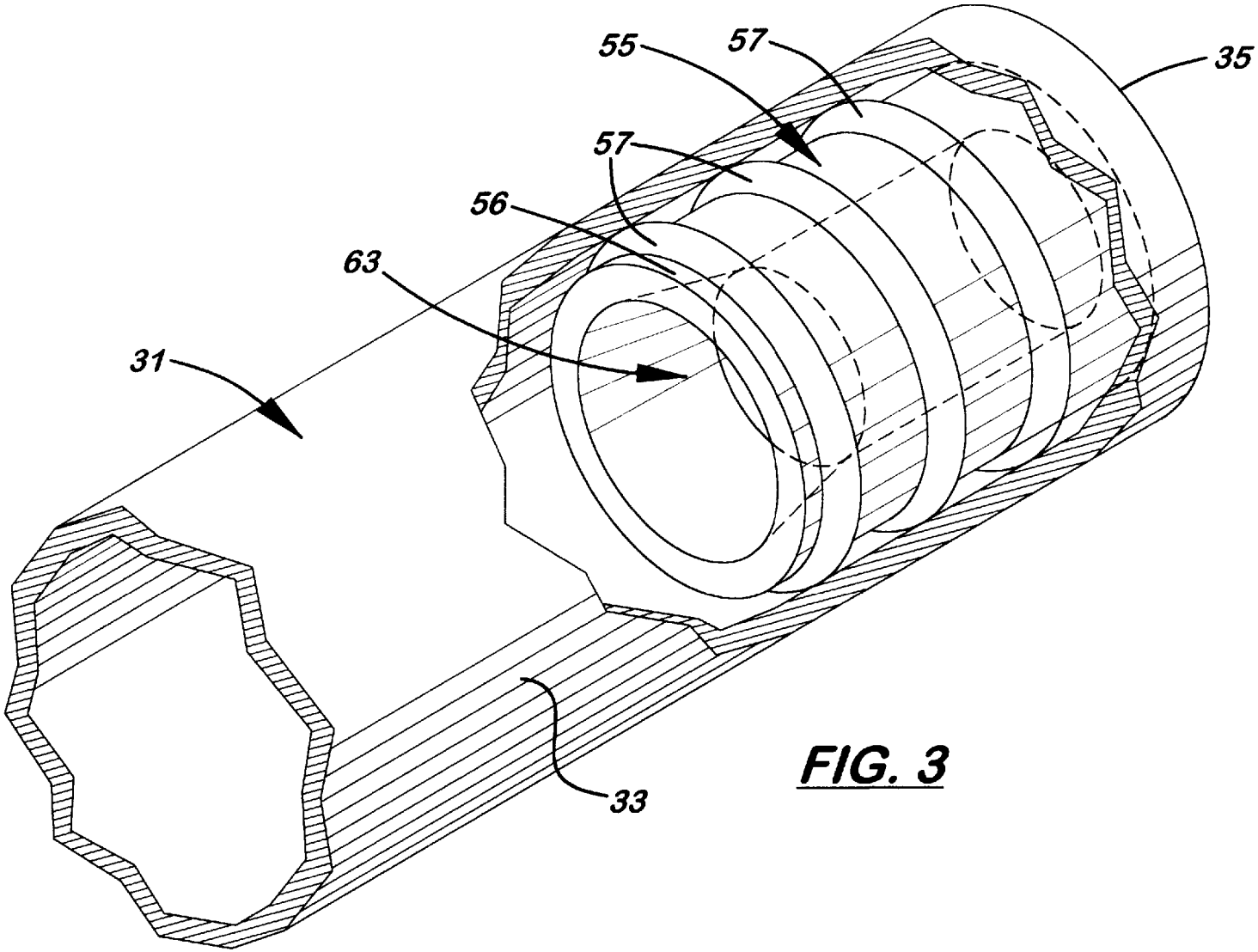
FIG. 3 is a perspective view of the support piece located in the tubular body.

As shown best in FIG. 2, the spare bulb container 31 includes a rigid tubular body 33 open at one end 34 and closed at the other end 35. The tubular body 33 is affixed to the cross-member 25. Preferably, the tubular body 33 is formed of iron or steel and is affixed to the cross-member 25 by welding.

Disposed over the open end 34 is an end piece 50. Disposed inside the tubular body 33 and adjacent to the closed end 35 is a support piece 55. The end piece 50 and support pieces 55 are formed of a relatively soft material, such as rubber, and sized to friction fit into the tubular body 33. More specifically, the end piece 50 and support piece 55 have an outer periphery 51, 56 that matches the shape of the inside surface of the tubular body 33. If the tubular body 33 is cylindrical, as shown in the Figs., the outer periphery 51, 56 of the end piece 50 and support piece 55, respectively, are generally cylindrical in shape. Preferably, the outer periphery 51, 56 of the end piece 50 and support piece 55, respectively, include one or more peripheral ribs 52, 57, respectively. The ribs 52, 57 taper toward the inside surface of the tubular body 33. Preferably, the outer diameter of the ribs 52, 57 are slightly greater than the inner diameter of the tubular body 33 and the diameters of the outer peripheries 51, 56 are slightly less than the inner diameter of the tubular body 33, as best seen in FIG. 2. As a result, the peripheral ribs 52, 57 slightly compress when located in the ends of the tubular body 33, resulting in a friction fit. The outer end 54 of the end piece 50 is enlarged to act as a handle and to limit the distance that the end piece 50 slides into the open end 34 of the tubular body 33.

Both the end piece 50 and support piece 55 include a central longitudinal hole 53, 63, respectively, sized to receive the opposite ends of a spare halogen bulb 45. When the end piece 50 and support pieces 55 are installed correctly in the tubular body 33, the holes 53, 63 face one another.

The length of the tubular body 33 is such that when the end piece 50 and support piece 55 are properly installed therein, the distance between the holes 51, 63 is sufficient so that the ends of a spare halogen bulb 45 securely hold the bulb 45 in a suspended position inside the tubular body 33. Because the end piece 50 and support piece 55 are soft, being formed of rubber or a similarly resilient material, they form a shock-absorbing support for spare halogen bulb 45.

As noted above, while the illustrated embodiment of the invention has been shown combined with a particular low-profile halogen work light, it is to be understood that the invention can be used with other types of low-profile halogen work lights, as well as with high-profile halogen work lights.

In addition to being incorporated into a variety of different types or work lights, rather than being welded to the frame of the work light, spare bulb containers formed in accordance with the invention can be attached in other manners, such as mechanically (bolts and nuts, rivets, etc.) or with a suitable adhesion. Also, rather than being cylindrical, the tubular body can have other cross-sectional shapes, e.g., square, triangular, hexagonal, etc. Obviously, the cross-sectional shape of the end pieces must be changed to match the chosen cross-sectional shape of the tubular body. Consequently, within the scope of the appended claims, it is to be understood that the invention can be practiced otherwise than as specifically described herein.

In compliance with the statute, the invention described herein has been described in language more or less specific as to structural features. It should be understood, however, that the invention is not limited to the specific features shown, since the means and construction shown, comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. In a halogen work light comprising a halogen lamp including an elongate halogen bulb mounted in a housing and a support frame for supporting the halogen lamp, the improvement comprising an elongate spare bulb container affixed to an exterior surface of the supporting frame of said halogen work light, said elongate spare bulb container including a tubular body open at one end and at an opposite closed end, one support piece and one end piece, said support and end pieces including an integral cavity for receiving an end of an elongate halogen bulb, said support piece being disposed adjacent to said closed end of said tubular body and said end piece being disposed in said open end of said tubular body.

2. The improvement claimed in claim 1, wherein said support frame and said tubular body are both formed of a weldable material and wherein said tubular body is affixed to said support frame by welding.

* * * * *